US007172081B2

(12) United States Patent
Trowsdale

(10) Patent No.: US 7,172,081 B2
(45) Date of Patent: Feb. 6, 2007

(54) FOLDING FRAME CONSTRUCTION

(75) Inventor: Darren Brian Trowsdale, Leeds (GB)

(73) Assignee: Vale Mill (Rochdale) Limited, Rochdale (GB)

( * ) Notice: Subject to any disclaimer, the term of this patent is extended or adjusted under 35 U.S.C. 154(b) by 180 days.

(21) Appl. No.: 10/466,586

(22) PCT Filed: Jan. 14, 2002

(86) PCT No.: PCT/GB02/00149

§ 371 (c)(1),
(2), (4) Date: Dec. 8, 2003

(87) PCT Pub. No.: WO02/057532

PCT Pub. Date: Jul. 25, 2002

(65) Prior Publication Data

US 2004/0104190 A1 Jun. 3, 2004

(30) Foreign Application Priority Data

Jan. 17, 2001 (GB) ..... 0101176.6

(51) Int. Cl.
*A47B 47/00* (2006.01)

(52) U.S. Cl. ..... 211/202; 211/200

(58) Field of Classification Search ..... 211/200, 211/201, 202, 194, 195, 105, 182, 189; 248/277.1, 248/164, 431, 166
See application file for complete search history.

(56) References Cited

U.S. PATENT DOCUMENTS

| | | | | |
|---|---|---|---|---|
| 127,881 | A * | 6/1872 | Hill | 211/202 |
| 2,388,637 | A * | 11/1945 | Edward | 211/170 |
| 3,133,645 | A | 5/1964 | Cecil | |
| 4,131,205 | A * | 12/1978 | Malecki | 211/200 |
| 4,628,560 | A * | 12/1986 | Clevett et al. | 14/2.4 |
| 4,828,123 | A * | 5/1989 | Basore | 211/202 |
| 6,427,858 | B2 * | 8/2002 | Sabounjian | 211/202 |
| 2004/0104190 | A1 * | 6/2004 | Trowsdale | 211/202 |

FOREIGN PATENT DOCUMENTS

| | | |
|---|---|---|
| BE | 352363 | 7/1928 |
| CH | 174613 | 4/1935 |
| CH | 182022 | 4/1935 |
| FR | 964393 | 8/1950 |
| GB | 919306 | 2/1963 |

(Continued)

*Primary Examiner*—Jennifer E. Novosad
(74) *Attorney, Agent, or Firm*—Bracewell & Giuliani LLP

(57) ABSTRACT

A folding frame construction for use as a clothers airer or drier comprises at least a first pair of U-shaped frames (10, 12) which are pivotally interconnected for folding about a first axis and which form the lowermost tier when in use, and a second pair of U-shaped frames (14, 16) which are pivotally interconnected for folding about a second axis generally parallel to the first axis and are pivotally connected to respective frames (10, 12) of the first pair so as to form a second tier during use, each frame (10, 12, 14, 16) comprising a pair of spaced side limbs (22) and the pivotal connections being made between the side limbs (22) of the various frames (10, 12, 14, 16) in such a way that the pairs of frames are in substantially parallel relation with each other when the frame construction is in the storage position.

16 Claims, 4 Drawing Sheets

FOREIGN PATENT DOCUMENTS

| | | | |
|---|---|---|---|
| GB | 1069981 | | 5/1967 |
| GB | 1208689 | | 10/1970 |
| GB | 1271499 | | 4/1972 |
| GB | 1285972 | | 8/1972 |
| GB | 2367239 A | * | 4/2002 |

* cited by examiner

FOLDING FRAME CONSTRUCTION

This invention relates to folding frame constructions for use in the airing and drying of clothes.

Such frame constructions are often fabricated from tube, wire and/or wooden components and are widely used for domestic purposes to provide a temporary storage area to air or dry clothes and other textile items. When not in-use, the frame construction is intended to collapse for storage.

An objective of the present invention is to provide a frame construction which is capable of collapsing in a very compact manner to facilitate storage in the home and also to facilitate storage during shipping and warehouse and retail shop storage.

According to first aspect of the present invention there is provided a folding frame construction comprising at least a first pair of frames which are pivotally interconnected for folding about a first axis and which form the lowermost tier when in use, and a second pair of frames which are pivotally interconnected for folding about a second axis generally parallel to the first axis and are pivotally connected to respective frames of the first pair so as to form a second tier during use, each frame comprising a pair of spaced side limbs and the pivotal connections being made between the side limbs of the various frames in such a way that the pairs of frames are in substantially parallel relation with each other when the frame construction is in the storage position and the frames of each pair are nested with each other.

By arranging the frames such that the frames of each pair are nested (more specifically substantially coplanar with each other) and the pairs of frames are substantially parallel with each other, a particular compact construction may be secured.

The pivotal connection between the frame of one pair and that of an adjacent pair may be offset relative to the one frame to allow the frames of adjacent pairs to be in substantially parallel relation in the storage position.

The pivotal connection may be afforded by a separate component carried by one frame of one pair for receiving a pivot pin which engages with the frame of an adjacent pair.

Alternatively the pivotal connection may be afforded by an integral part of one frame which is angularly related to the frame to provide an offset pivotal connection.

According to second aspect of the present invention there is provided a folding frame construction comprising at least a first pair of frames which are pivotally interconnected for folding about a first axis and which form the lowermost tier when in use, and a second pair of frames which are pivotally interconnected for folding about a second axis generally parallel to the first axis and are pivotally connected to respective frames of the first pair so as to form a second tier during use, each frame comprising a pair of spaced side limbs and the pivotal connections being made between the side limbs of the various frames in such a way that the frames of each pair nest together in the storage position.

There may be a third pair of nesting frames pivotally connected to respective ones of the second pair so as to form a third tier in use, the second and third frames being coupled together in the manner defined above in said first and second aspects of the invention. It is also contemplated that there may be a fourth pair of frames arranged in the same fashion.

The nesting arrangement may be such that the one limb of one frame in each pair lies outside an adjacent limb of the other frame while the other limb of said one frame lies inside an adjacent limb of the other frame.

Each frame may be of U-shaped configuration with a cross member interconnecting the side limbs thereof. Each frame may be provided with additional cross-members or rails spanning the space between each pair of side limbs and so arranged that the rails are connected to outer faces of the side limbs without encroaching to any substantial extent (if at all) on the space between the side limbs of each frame.

All of the frames of the construction may have the substantially the same width dimension between the side limbs thereof.

The frames of each pair may be pivotally connected so that, in the folded condition of the construction, the free ends of each U-shaped frame terminate at a location closer to the associated pivotal connections than the cross-member of the other frame.

The side limbs may be substantially rectilinear or they may be curvilinear.

The frame construction may include a device for maintaining the frame construction in its erected condition.

The device may be selectively operable to allow the frame construction to be maintained in different height erected conditions.

The frame construction may include a single device for this purpose or there may be more than one such device.

The device may be in the form of a latch.

In another aspect of the invention there is provided a folding frame construction comprising at least a first pair of frames which are pivotally interconnected for folding about a first axis and which form the lowermost tier when in use, and a second pair of frames which are pivotally interconnected for folding about a second axis generally parallel to the first axis and are pivotally connected to respective frames of the first pair so as to form a second tier during use, and at least one latch coupling adjacent side limbs of one pair of frames for holding the frame construction in its in-use condition, the latch being pivotally connected to one side limb and having a slot therein which receives a pin on the other side limb, the slot having at least one lateral recess for reception of the pin so as to prevent relative pivotal movement between the frames.

The latch may be produced as a single component, preferably a one-piece plastics moulding.

The slot may be of arcuate configuration so as to be upwardly concave in the in-use condition and the lateral recess or recesses may be provided on a concave side of the slot.

The latch may have two lateral recesses for reception of the pin in order to hold the frames in more than one angularly related position in use.

The invention will now be described by way of example only with reference to the accompanying drawings, in which.

Figure 1:
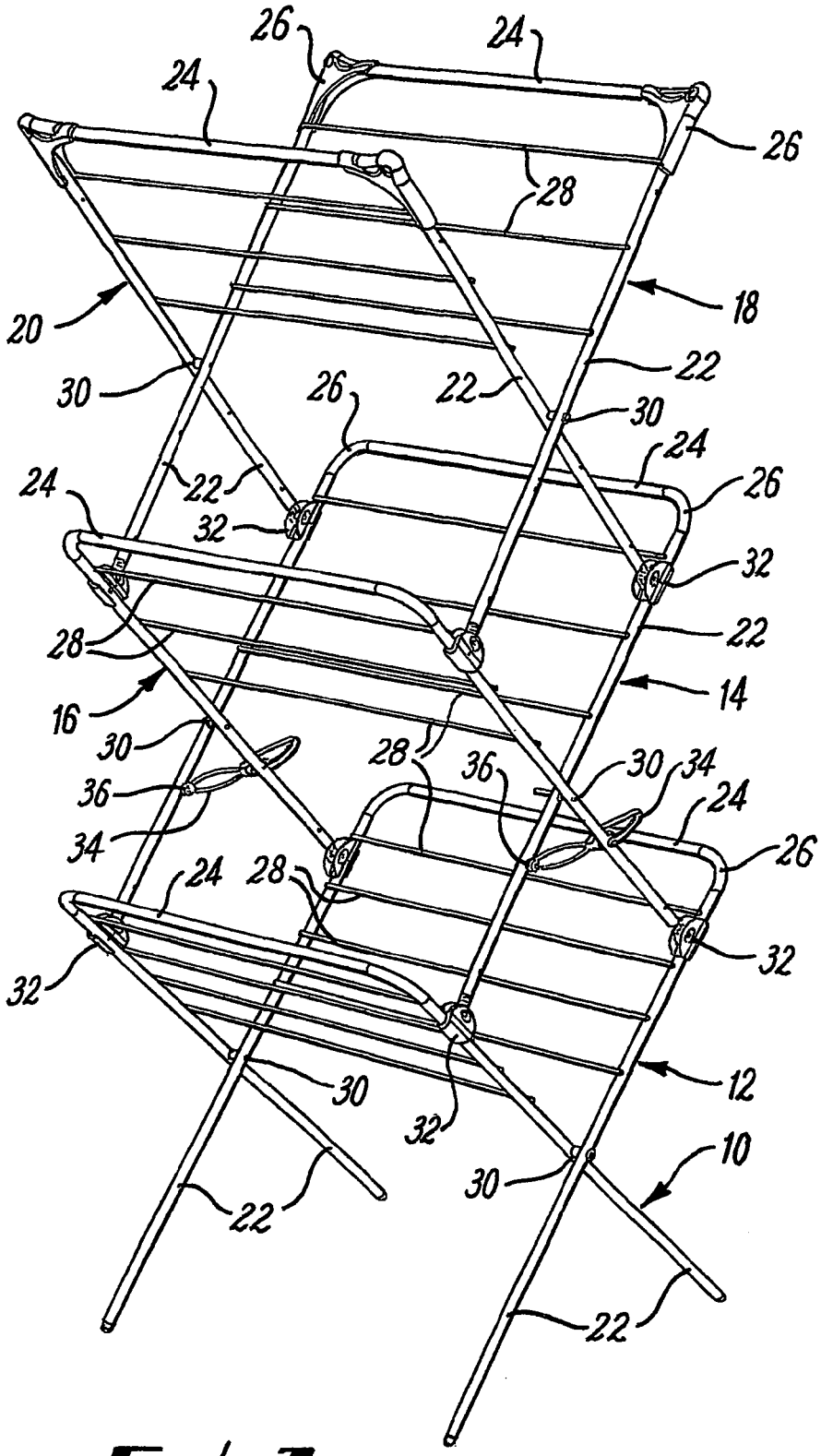
FIG. 1 is a perspective view showing a clothes airer/drier in its erected condition of use.

Referring to the drawings, a free-standing folding frame construction in the form of a clothes airer/drier has three tiers of frames, although it will be appreciated that it may be modified to have only two tiers or more than three tiers. The tiers are constructed of U-shaped components with pivot points configured in such a way as to allow all of the U-shaped components to lie in a parallel or near parallel configuration with the airer is collapsed.

The airer/drier comprises a first pair of frames 10, 12 forming the base of the construction and hence the lowermost tier in use, a second pair 14, 16 forming a second tier, and a third pair 18, 20 forming the third and uppermost tier. Each frame is of U-shaped configuration comprising tubular parallel side limbs 22 and a tubular cross-member 24 which may each be fabricated from metal tube, the cross-member 24 being connected to the side limbs by bridging pieces 26 which may be plastics mouldings. Additional cross-members 28 in the form for example of wire rods bridge the side limbs to afford rails for supporting items of clothing and the like. These rods are connected to one side of the associated frame, i.e. they are overlie the side limbs as will be apparent especially from FIG. 3. It will be noted that the rods 28 do not encroach on the space between the associated side limbs. The width of each frame may be the same for all of the frames of the construction.

The frames of each pair are pivotally connected to form an "X" framework by pins or rivets 30. A feature of the invention is that these pivotal connections are so arranged that one frame of each pair is offset with respect to the associated frame in the direction of the pivotal axis so that one side limb 22 of each frame (e.g. the right hand side limb 22 of frame 10 as viewed in FIG. 1) lies inside the side limb of the associated frame (e.g. side limb 22 of frame 12) while the other side limb lies outside that of the associated frame, e.g. the left hand side limb of frame 10 lies outside the left hand side limb of frame 12. Also, it will be noted that the arrangement is reversed from one pair of frames to the next so, whereas the right hand side limb of frame 10 lies inside the right hand side limb of frame 12, in the next tier the right hand side limb of frame 16 lies outside that of frame 14 etc.

Figure 2:
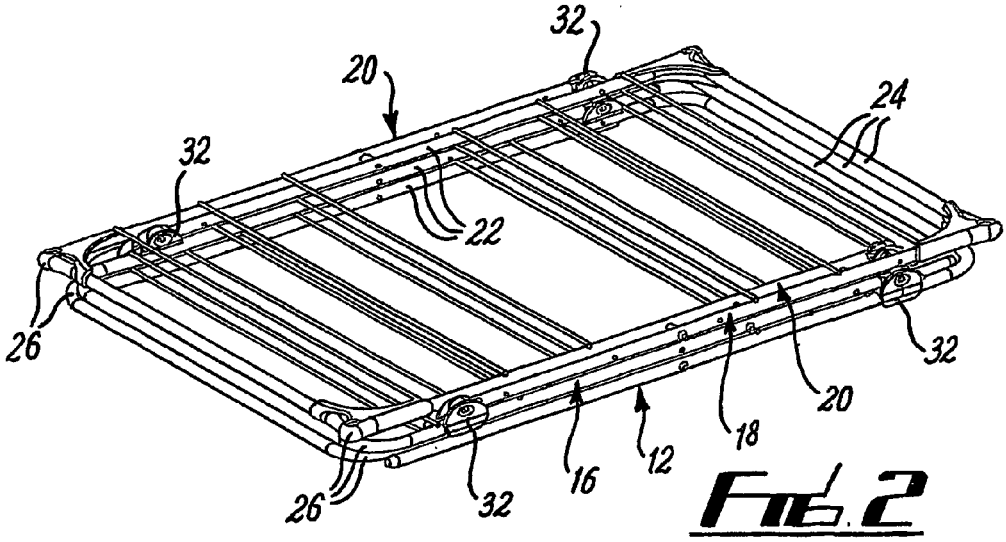
FIG. 2 is perspective view showing the clothes airer/drier in its folded storage position.
Figure 3:
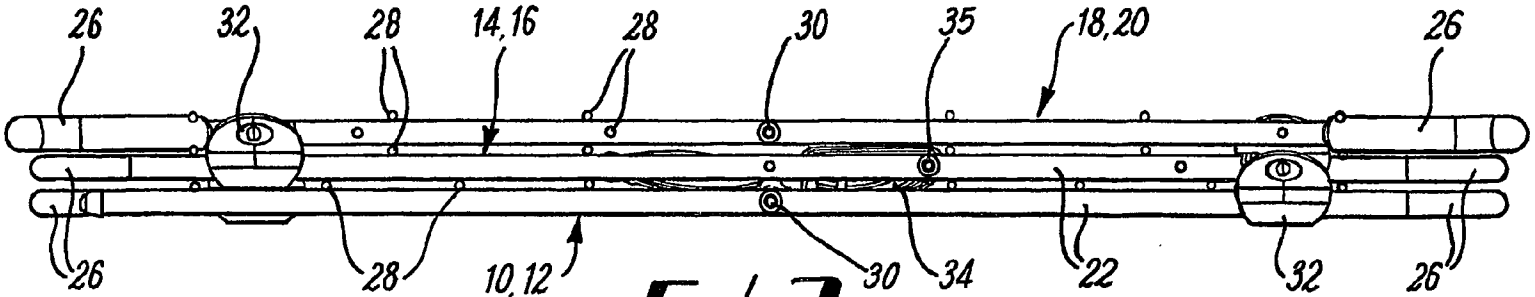
FIG. 3 is a side view of the clothes airer/drier in its folded storage position.

The pivotal connections 30 associated with each pair of frames are so positioned that the distance between the pivotal axis and the free ends of the side limbs is slightly less than the distance between the pivotal axis and the associated cross-member 24 so that, coupled with the offset relation of the frames in each pair and the positioning of the rods 28, the frames can be folded into a nested relation in which the frames are interlaced with each other in the manner that will be apparent from FIGS. 2 and 3 in which the side limbs of one frame lie in substantially the same plane as the sides limbs of the associated frame of the pair with the pairs of frames arranged in substantially parallel relation with each other.

Each pair of side frames is connected to the adjacent pair by connectors 32 which are coupled to the side limbs of lower frames at a location adjacent the associated cross-member 24 and mount pivot pins or the like which are engaged with the lower ends of the side limbs of the frames above, the arrangement being such that the pivotal connection is offset with respect to the frame of one pair so that, when the construction is collapsed, each pair of frames is substantially parallel with the adjacent pair of frame(s).

Figure 4:
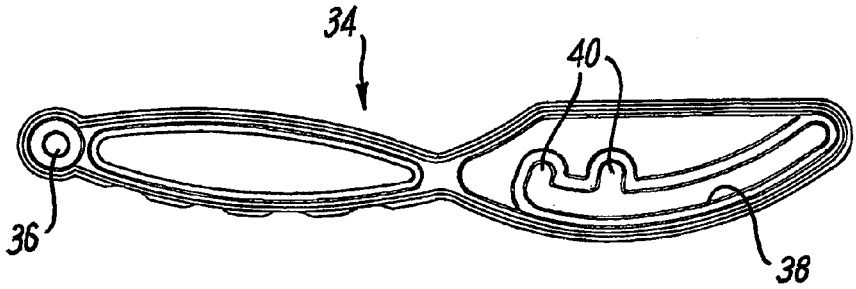
FIG. 4 is side view showing one of the latches of the airer/drier.

The frame construction is maintained in its position or positions of use as illustrated in FIG. 1 by means of latches 34 which, in this case, are associated with the middle tier but may if desired be associated instead with one of the other tiers. Each latch is formed as a single piece component, e.g. by injection moulding, and is pivotally coupled by pin 36 at one end to the limbs of the frame 14. It will be noted that one latch is pivotally connected to the inside and one to the outside of frame 14. Each latch includes an arcuate slot 38 (see FIG. 4) which is upwardly concave and includes a pair of lateral recesses 40 on the concave side of the slot. The slot 38 receives a pin 35 or such like projecting from the frane 16, one projecting inwardly and the other outwardly. In the in-use condition of the frame construction, the latching pins engage in one or other of the recesses 40 of each slot to maintain the in-use condition. The overall height of the frame construction will depend on which of the recesses 40 are used to retain the latch in position.

To collapse the frame construction for storage purposes, the latches 34 are lifted about axis 36 to disengage the latching pins from the recesses 40 to free them for sliding movement towards the other end of the slots 38. When unlatched, the frame construction can be folded to the compact storage condition illustrated in FIGS. 2 and 3. As will be seen from FIG. 3 in particular, in its fully folded condition, the frames of each pair are coplanar with each other, the pairs of frames are parallel with each other and the overall depth of the construction approximately corresponds to the combined diameters of three side limbs 22 and three rods 28.

When restoring the construction to the in-use condition, the frames are simply manipulated by raising the frames 18, 20 to cause the construction to hinge and as it is opens up and extends the latching pins travel along the slots 38 until they reach the recesses 40 and by appropriately manipulating the frames and, if necessary, the latches, the user may cause the latching pins (aided by gravity) to enter the appropriate recesses, depending on the desired height of the construction.

While two latches are illustrated in the accompanying drawings, it will be appreciated that it is possible to use only a single latch in order to maintain the construction in a selected erected conditions.

Figure 5:
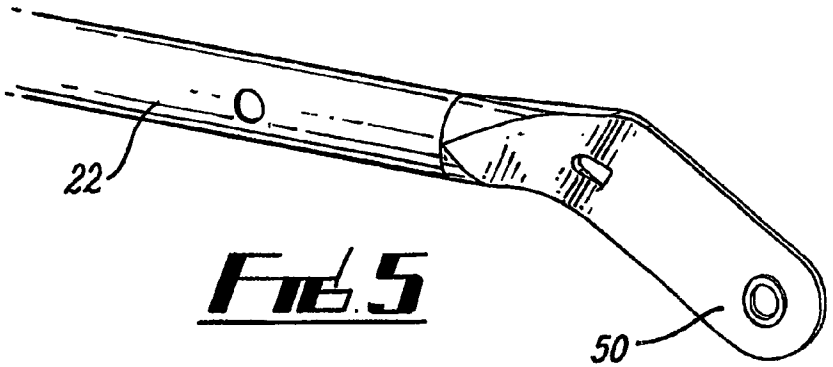
FIGS. 5 to 7 are enlarged fragmentary views of a modification in which the end of a frame side limb is cranked to afford offsetting of the pivotal connections between frames of adjacent pairs.
Figure 6:
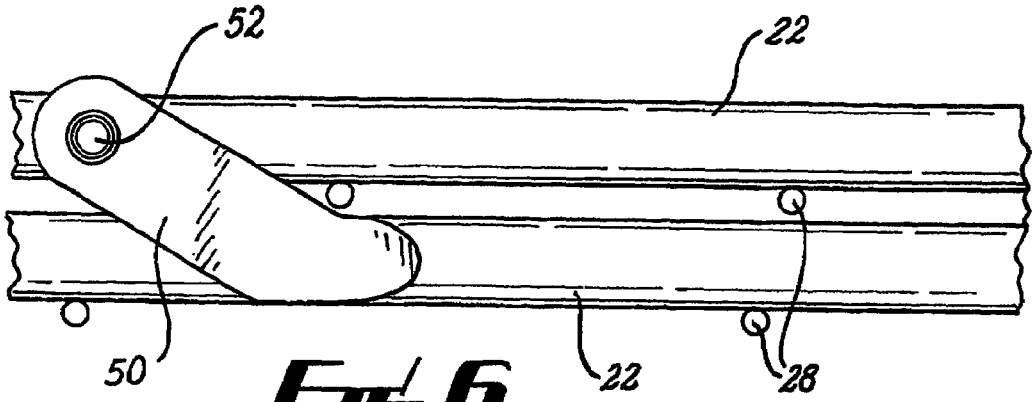
Figure 7:
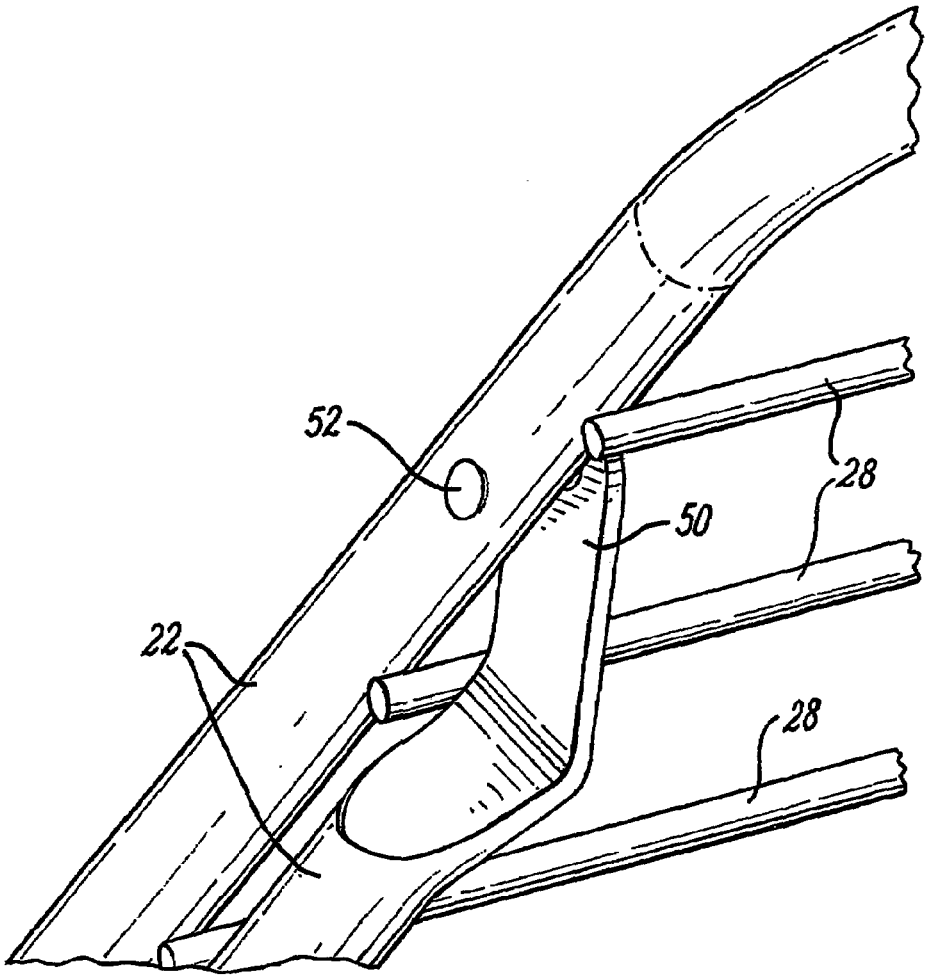

In the embodiment of FIGS. 1 to 4, the parallel relation between successive pairs of frames is achieved by means of the connectors 32 which may be plastics components separate from the frames. In a modification as illustrated in FIGS. 5 to 7, instead of using separate connectors, the offset pivotal connections are implemented by cranking or dog-legging the free ends 50 of the side limbs as illustrated and coupling the frames in each pair directly to the frames of adjacent pairs by pivot pins 52. Those end portions of the tubular side limbs may also be flattened. In this way, the connectors 32 in the embodiment of FIGS. 1 to 4 may be omitted and the pivot pins may directly engage the pairs of frames interconnected thereby.

In the illustrated embodiments, the side limbs of the frames are rectilinear; in another modification of the invention, the side limbs of all of the frames may be curvilinear, i.e. with a relatively shallow curve, as viewed from the direction in which FIGS. 3 and 5 are taken. In this modification, it will be appreciated that the curvature will be such that, when the airer is in its collapsed condition, all of the curvilinear side limbs are parallel with each other and the side limbs of each frame are coplanar with each other.

Whilst endeavouring in the foregoing specification to draw attention to those features of the invention believed to be of particular importance, it should be understood that the Applicant claims protection in respect of any patentable feature or combination of features disclosed herein and/or shown in the drawings whether or not particular emphasis has been placed on such feature or features. Also, whilst the invention is described by way of a specific example, it is to be understood that features of the specific example may be the subject of protection in a generic sense, independently of other features of the specific embodiment.

The invention claimed is:

1. A folding frame construction comprising at least a first pair of frames which are pivotally interconnected by a first pivotal connection for folding about a first axis and which form a lowermost tier when in use, and a second pair of frames which are pivotally interconnected by a second pivotal connection for folding about a second axis generally parallel to the first axis and are pivotally connected to respective frames of the first pair so as to form a second tier during use, each frame being of U-shaped configuration comprising a pair of spaced side limbs with a cross member interconnecting the side limbs thereof, the pair of spaced side limbs defining a pair of outside limbs and a pair of inside limbs, the first and second pivotal connections connecting the side limbs of the first and second pairs of frames in such a way that the first and second pairs of frames are in substantially parallel in relation to each other when the frame construction is in a storage position, wherein the frames of each pair are nested, and substantially coplanar, with each other, when the frame construction is in the storage position, and the frames of each pair are pivotally interconnected so that, in the folded condition of the construction, a free ends of each U-shaped frame terminates at a location closer to the associated pivotal interconnections than the cross-member of the other frame, and the outside limbs on the first pair of frames are pivotally connected to the outside limbs on the second pair of frames and that the inside limbs on the first pair of frames are pivotally connected to the inside limbs on the second pair of frames.

2. A construction as claimed in claim 1, in which the pivotal connection between the frame of the first pair and that of the second pair is offset relative to each other to allow the frames of the first and second pairs to be in substantially parallel relation in the storage position.

3. A construction as claimed in claim 1, in which the pivotal connection is a separate component carried by one frame of the first pair for receiving a pivot pin which engages with the frame of an adjacent pair.

4. A construction as claimed in claim 1, in which the pivotal connection is an integral part of one frame which is angularly related to the other frame to provide an offset pivotal connection.

5. A construction according to claim 1, wherein the frames of each pair nest in such a way that one limb of one frame in each pair lies outside an adjacent limb of the other frame while the other limb of said one frame lies inside an adjacent limb of the other frame.

6. A construction as claimed claim 1, in which each frame is provided with additional cross-members or rails spanning a space between each pair of side limbs and so arranged that the rails are connected to outer faces of the side limbs without encroaching to any substantial extent, on the space between the side limbs of each frame.

7. A construction as claimed in claim 1, in which all of the frames of the construction have substantially the same width dimension between the side limbs thereof.

8. A construction as claimed in claim 1, including a device for maintaining the frame construction in its erected condition.

9. A construction as claimed in claim 8, wherein the device is selectively operable to allow the frame construction to be maintained in different height erected conditions.

10. A construction as claimed in claim 8, wherein the device is a latch.

11. A construction as claimed in claim 10, wherein the latch is a single piece component.

12. A construction as claimed in claim 10, wherein the latch couples adjacent side limbs of one pair of frames for holding the frame construction in its erected condition, the latch being pivotally connected to one side limb and having a slot therein which receives a pin on the other side limb, the slot having at least one lateral recess for reception of the pin so as to prevent relative pivotal movement between the frames.

13. A construction as claimed in claim 12, in which the slot is of arcuate configuration so as to be upwardly concave in the erected condition and the at least one lateral recess is provided on a concave side of the slot.

14. A construction as claimed in claim 12, in which the latch has two lateral recesses for reception of the pin in order to hold the frame construction in more than one erected position in use.

15. A construction as claimed in claim 1, including at least one additional pair of frames.

16. A construction as claimed in claim 1, in which the side limbs of the frames are substantially rectilinear.

* * * * *